US008152582B2

(12) United States Patent
Nagasaka et al.

(10) Patent No.: US 8,152,582 B2
(45) Date of Patent: Apr. 10, 2012

(54) METHOD OF MANUFACTURING IMAGE DISPLAYING APPARATUS

(75) Inventors: Kazuhiro Nagasaka, Yokohama (JP); Isamu Shigyo, Chiba (JP); Kazutaka Yanagita, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 352 days.

(21) Appl. No.: 12/427,071

(22) Filed: Apr. 21, 2009

(65) Prior Publication Data

US 2009/0270006 A1 Oct. 29, 2009

(30) Foreign Application Priority Data

Apr. 24, 2008 (JP) ..... 2008-113330

(51) Int. Cl.
*H01J 9/24* (2006.01)

(52) U.S. Cl. ..... 445/24; 313/292

(58) Field of Classification Search ..... 445/24, 445/23, 25, 26, 66; 313/292
See application file for complete search history.

(56) References Cited

U.S. PATENT DOCUMENTS 5,980,346 A * 11/1999 Anderson et al. ..... 445/24
6,981,905 B2 1/2006 Yakou et al. ..... 445/24
7,258,588 B2 8/2007 Yakou et al. ..... 445/24
2002/0182716 A1* 12/2002 Weisbuch et al. ..... 435/287.2
2004/0108044 A1* 6/2004 Shioya et al. ..... 156/160
2004/0137820 A1 7/2004 Yakou et al.

FOREIGN PATENT DOCUMENTS

JP 2004-172097 A 6/2004

* cited by examiner

*Primary Examiner* — Bumsuk Won
*Assistant Examiner* — Andrew Coughlin
(74) *Attorney, Agent, or Firm* — Fitzpatrick, Cella, Harper & Scinto

(57) ABSTRACT

In a method of manufacturing an image displaying apparatus which has plural spacers for defining a distance between substrates, the present invention enables to effectively perform a process of assembling the spacers in a less number of steps and improves accuracy of a spacer assembling position. In this method, in case of clamping plural spacers respectively by individual hands, positioning the plural spacers on the substrate in a lump, applying an adhesive to the positioned spacers, heat hardening the adhesive, and fixing the spacers to which the adhesive was applied to the substrate, pitches of the hands are adjusted according to heat expansion of the substrate in the pitch direction of the spacers occurred due to the heating of the adhesive.

3 Claims, 7 Drawing Sheets

METHOD OF MANUFACTURING IMAGE DISPLAYING APPARATUS

BACKGROUND OF THE INVENTION

1. Field of the Invention

The present invention relates to a method of manufacturing a flat type image displaying apparatus which has a pair of substrates (a face plate and a rear plate) constituting a display panel and in which spacers are provided between the substrates as an atmospheric pressure resistant member. More particularly, the present invention relates to a method of manufacturing the image displaying apparatus in which the rod-like or long and narrow plate-like longitudinal spacers are provided between the substrates constituting a pair of the substrates.

2. Description of the Related Art

Conventionally, in a method of manufacturing an image displaying apparatus which has plural spacers for defining a distance between substrates constituting a pair of the substrates, a method disclosed in Japanese Patent Application Laid-Open No. 2004-172097 (called the patent document 1) has been known as a process of assembling the spacers to the substrate. In the method disclosed in the patent document 1, a hand for clamping the spacer and positioning the clamped spacer on the substrate and a spacer pressing mechanism for pressing both ends of the spacer in the longitudinal direction respectively onto the substrate are used. More specifically, the spacer which was positioned on the substrate by using the hand is first pressed onto the substrate by using the spacer pressing mechanism. Then, an adhesive is applied to the pressed spacer, the spacer to which the adhesive was applied is vacuum-dried and temporarily fixed in a vacuum drying furnace, the spacer pressing mechanism is released, the adhesive is heat hardened, and then the spacer on which the adhesive was heat hardened is really fixed to the substrate.

However, in the above-described conventional method, it is necessary, after positioning the spacer on the substrate by using the hand and before fully fixing the positioned spacer by heating, to locate the spacer pressing mechanism, perform the vacuum drying process and release the spacer pressing mechanism. For this reason, in this case, there is a problem that manufacturing efficiency is bad because the number of processes is large. In addition, there is a problem that positioning stability is bad because the spacer clamped by the hand and then transported to a certain position on the substrate has to be transferred to the pressing by the spacer pressing mechanism.

SUMMARY OF THE INVENTION

The present invention has been completed in consideration of the above-described conventional problems. Under the circumstances, the present invention aims to enable, in a method of manufacturing an image displaying apparatus which has plural spacers for defining a distance between substrates constituting a pair of the substrates, to effectively perform a process of assembling the spacers in a less number of steps. Moreover, the present invention aims to enable to improve accuracy of a spacer assembling position.

To solve the above-described conventional problems, the present invention provides a manufacturing method of an image displaying apparatus which has plural spacers for defining a distance between substrates, the manufacturing method comprising: assembling spacers by clamping both ends of each of the spacers in a longitudinal direction thereof respectively with individual hands, positioning the spacers on one of the substrates in a lump, applying an adhesive to the positioned spacers, heat hardening the adhesive, and fixing the spacers to which the adhesive was applied to the one of the substrates, and, in the assembling of the spacers, a pitch of the hands adjacent in a pitch direction of the spacers is adjusted according to heat expansion of the substrate in the pitch direction of the spacers occurred due to the heating of the adhesive.

According to the present invention, each of the plural spacers is clamped by the individual hand, and the pitch of the adjacent hands is adjusted according to the heat expansion of the substrate in the pitch direction of the spacers due to the heating of the adhesive. For this reason, even if the hands continue to clamp the spacers until the heat hardening of the adhesive is completed, it is possible to prevent that the relative positions of the substrate and the spacers vary due to the heat expansion of the substrate, and it is also possible to prevent that the spacers are damaged due to such a variation of the relative positions.

As described above, according to the present invention, it is unnecessary to transfer the spacers clamped by the hands to another jig. In addition, it is possible to fully fix the spacers to the substrate by directly heat hardening the adhesive without temporal fixing. For this reason, it is possible to significantly reduce the number of processes as compared with the method in the related background art. As a result, it is possible to improve manufacturing efficiency and improve accuracy of the spacer assembling positions.

Further features of the present invention will become apparent from the following description of the exemplary embodiments with reference to the attached drawings.

DESCRIPTION OF THE EMBODIMENTS

Hereinafter, one example of a method of manufacturing an image displaying apparatus, according to the present invention will be described with reference to FIGS. 1 to 10.

First of all, an outline of the image displaying apparatus will be described.

Figure 1:
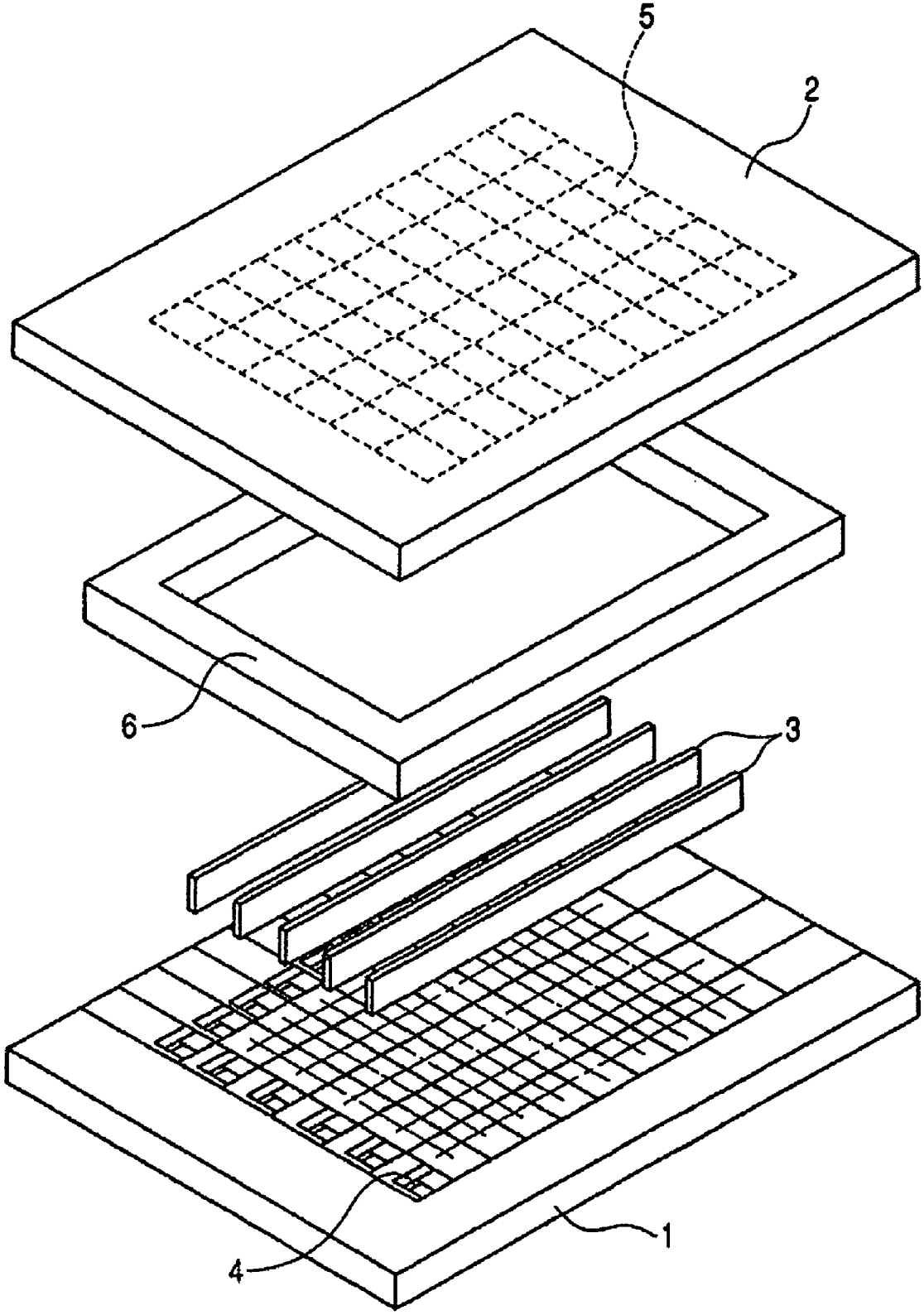
FIG. 1 is a schematic exploded perspective diagram illustrating an example of an image displaying apparatus which is the target to be manufactured in the present invention.
Figure 2:
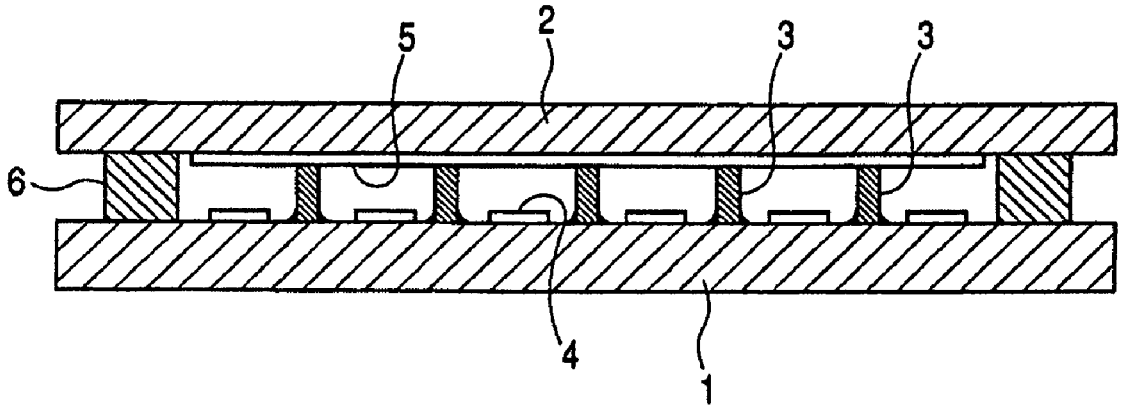
FIG. 2 is a schematic cross section diagram illustrating the assembled image displaying apparatus illustrated in FIG. 1.

As illustrated in FIGS. 1 and 2, the image displaying apparatus which is intended to be manufactured by the present invention has plural spacers 3 between a pair of a substrate 1 and a substrate 2 so as to define a distance between the substrates 1 and 2.

Further, the substrate 1 constitutes a rear plate on which plural electron-emitting devices 4 are arranged in a matrix, and the substrate 2 constitutes a face plate on which a phosphor 5 partitioned by a black matrix is arranged. Furthermore, the substrate 1 and the substrate 2 are oppositely arranged so that the surface of the substrate 1 on which the electron-emitting devices 4 has been formed and the surface of the substrate 2 on which the phosphor 5 has been attached faces each other. Furthermore, the rod-like or long and narrow plate-like longitudinal spacers 3 are arranged between the substrate 1 and the substrate 2, the arranged spacers 3 are surrounded by a frame 6, and the inside of the frame 6 is made vacuum.

The electron-emitting devices 4 formed on the substrate 1 are matrix-driven, and an electron beam is irradiated from the selectively driven electron-emitting device 4 to the phosphor 5. Then, if the electron beam is irradiated to the phosphor 5, light is emitted from the phosphor 5, whereby an image is formed on the phosphor 5.

In case of manufacturing the image displaying apparatus, first, the electron-emitting devices and the necessary wirings are formed on the substrate 1, and the phosphor 5 and the necessary wirings are formed on the substrate 2. Then, the spacers 3 are attached to the substrate 1 or the substrate 2, the substrates 1 and 2, the spacers 3 and the frame 6 are assembled so that the spacers 3 arranged between the substrates 1 and 2 are surrounded by the frame 6. Thereafter, the substrates 1 and 2, the spacers 3 and the frame 6 which have been assembled are sealed, and the inside of the frame 6 is set to be in a vacuum atmosphere.

Figure 3:
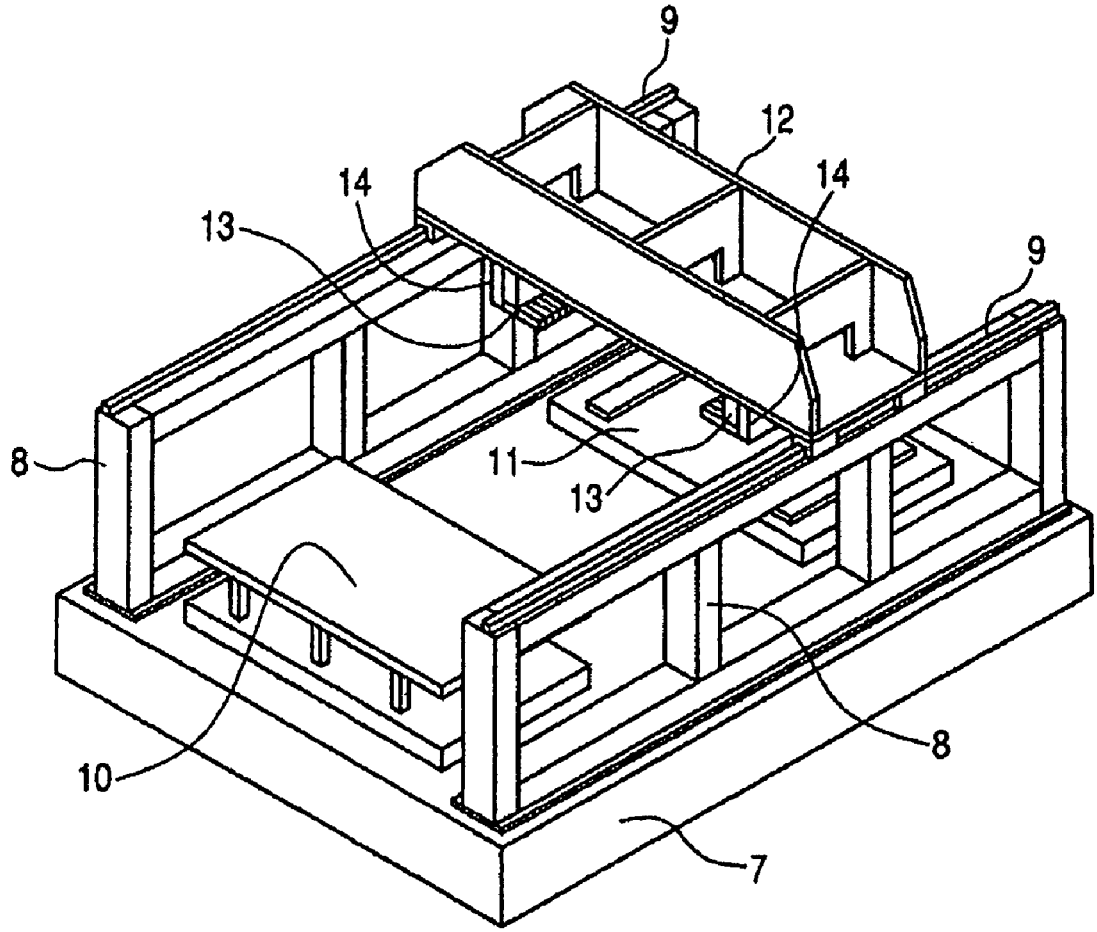
FIG. 3 is a perspective diagram roughly illustrating a spacer assembling apparatus.

Incidentally, the spacers 3 are attached and assembled to the substrate 1 or the substrate 2 in a spacer assembling step in which a spacer assembling apparatus as illustrated in FIG. 3 is used. Here, although the spacers 3 are attached to either the substrate 1 or the substrate 2, it is assumed that, in the following description, the spacers 3 are attached and assembled to the substrate 1 acting as the rear plate.

In FIG. 3, support frames 8 are provided at both sides of a stand 7, and guide rails 9 are provided on the respective support frames 8.

A table 10 on which the substrate 1 (see FIGS. 1 and 2) is mounted and a spacer magazine 11 are provided on the stand 7. Further, a column 12 which can be moved along the guide rails 9 is provided above the stand 7. Here, it should be noted that the column 12 can be moved between the position above the spacer magazine 11 and the position above the table 10.

Figure 4:
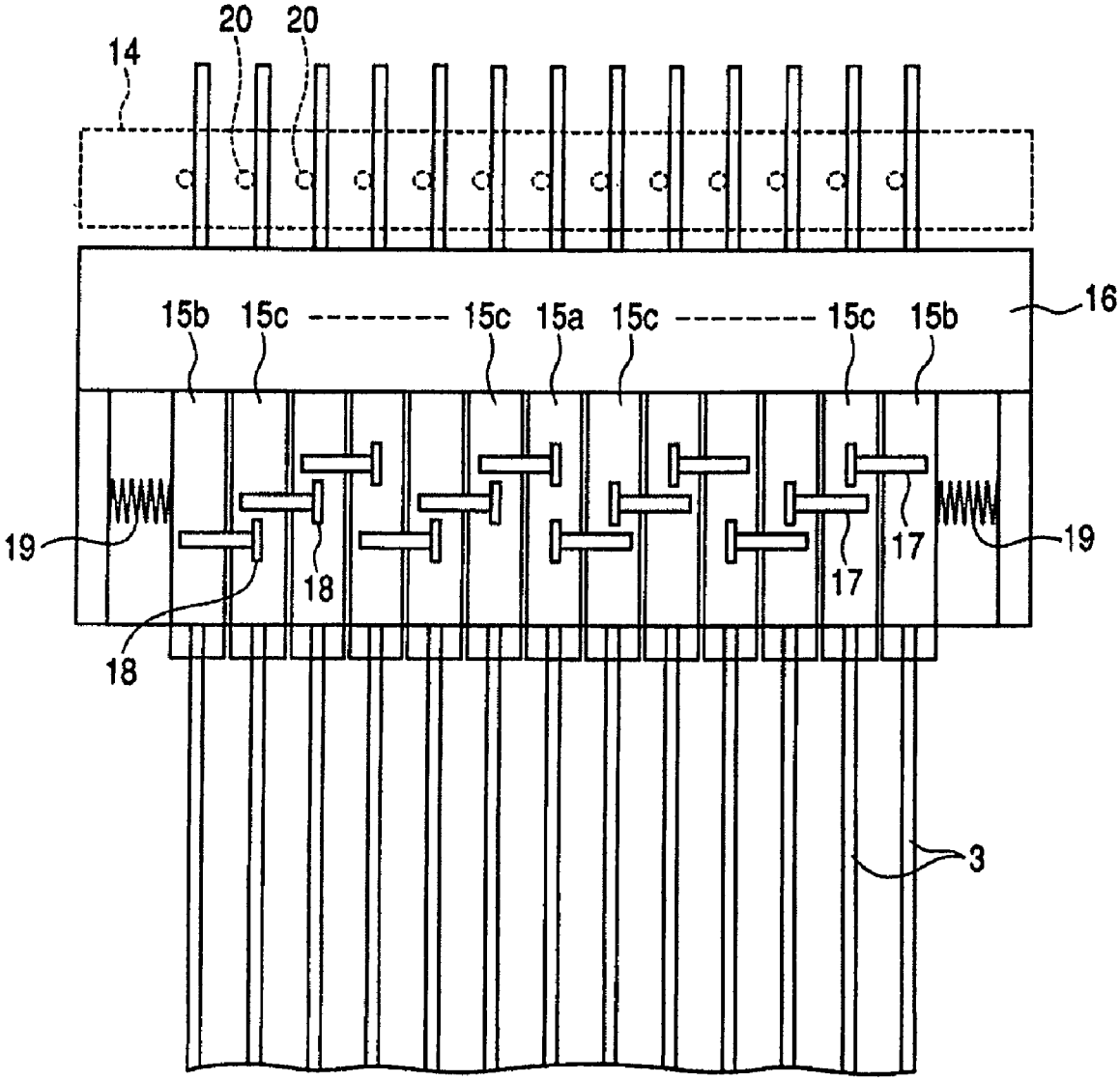
FIG. 4 is an enlarged plan view of a hand unit.
Figure 5:
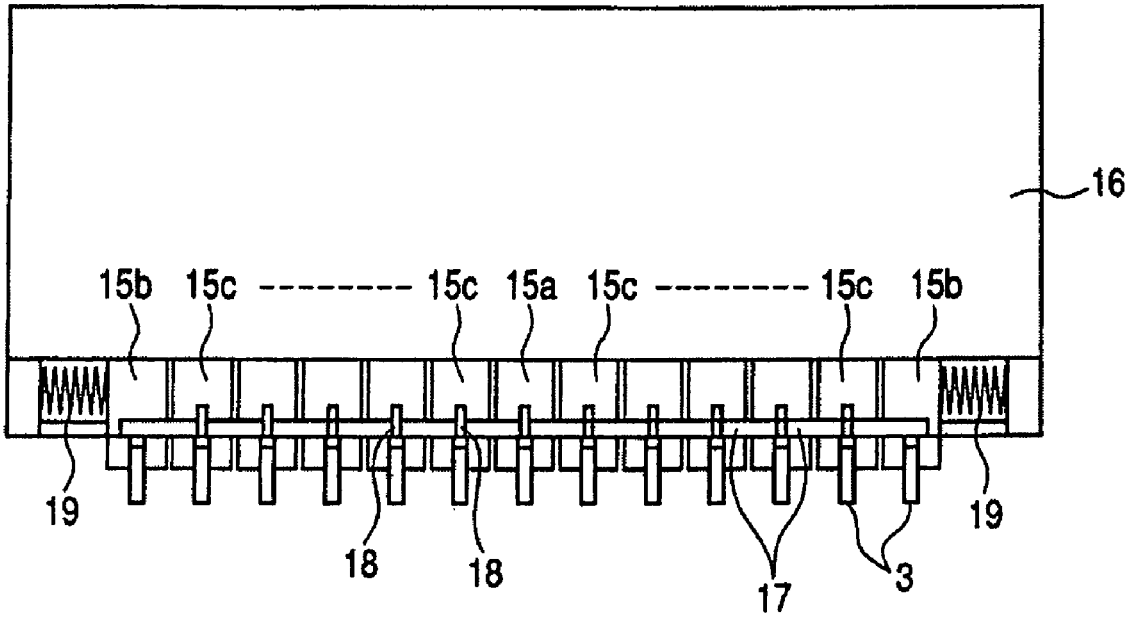
FIG. 5 is an enlarged elevation view of the hand unit.

Hand units 13 each of which is enlargedly illustrated in FIGS. 4 and 5 are provided on the side of the lower surface of the column 12 so as to be opposite to each other. Here, the hand units 13 can be moved in the up-and-down direction and the opposite direction. Further, a camera unit 14 is attached to the column 12 on the side of the rear surface of the hand unit 13. Furthermore, the hand unit 13 can apply reverse force by means of a spring or the like in the direction expanding the distance between the opposite hand units 13 to apply tension to the clamped spacers 13 so that the straight spacers 13 can be supplied to the substrate 1.

Each of the opposite hand units 13 constituting the pair of the hand units 13 is equipped with plural hands 15*a*, 15*b* and 15*c* for individually clamping both ends of the respective longitudinal spacers 3 to be attached and assembled to the substrate 1. Here, the hand 15*a* is the central hand, the hands 15*b* are the hands at both ends, and the hands 15*c* are the intermediate hands other than the central hand 15*a* and the both-end hands 15*b*.

Each of the hands 15*a*, 15*b* and 15*c* is provided on a hand unit main body 16 so as to be independently moved in the pitch direction of the spacers 3 clamped by the hands 15*a*, 15*b* and 15*c*. Moreover, a micro-movement mechanism 17 is provided on each of the hands 15*b* and 15*c* other than the central hand 15*a*. Here, it should be noted that a mechanism such as a piezoelectric device or the like which can perform hyperfine expansion and contraction and has a portion (called an expansion/contraction unit hereinafter) capable of controlling an expansion amount and a contraction amount is used as the micro-movement mechanism 17.

A pressing unit 18 is provided on each of the hands 15*a* and 15*c* other than the both-end hands 15*b*, and the expansion/contraction unit of the micro-movement mechanism 17 provided on each of the hands 15*b* and 15*c* is in contact with the pressing unit 18 provided on the hand 15*a* or the hand 15*b* which is adjacent on the central side. In particular, since the two pressing units 18 are provided on the central hand 15*a*, the expansion/contraction units of the micro-movement mechanisms 17 respectively provided on the hands 15*c* which are adjacent on the right and left sides of the central hand 15*a* are in contact with these pressing units 18 of the central hand 15*a*.

A slight gap is provided between each of the hands 15*a*, 15*b* and 15*c* and its adjacent hand, and each of the hands 15*a*, 15*b* and 15*c* is arranged in the state that the expansion/contraction unit of the micro-movement mechanism 17 is in contact with the pressing unit 18 of each hand. Further, since springs 19 are provided respectively on the outer sides of the both-end hands 15*b*, the respective hands 15*a*, 15*b* and 15*c* are resiliently held between the provided springs 19.

Plural cameras 20 are provided on the camera unit 14 in correspondence with the respective hands 15*a*, 15*b* and 15*c*.

Figure 6:
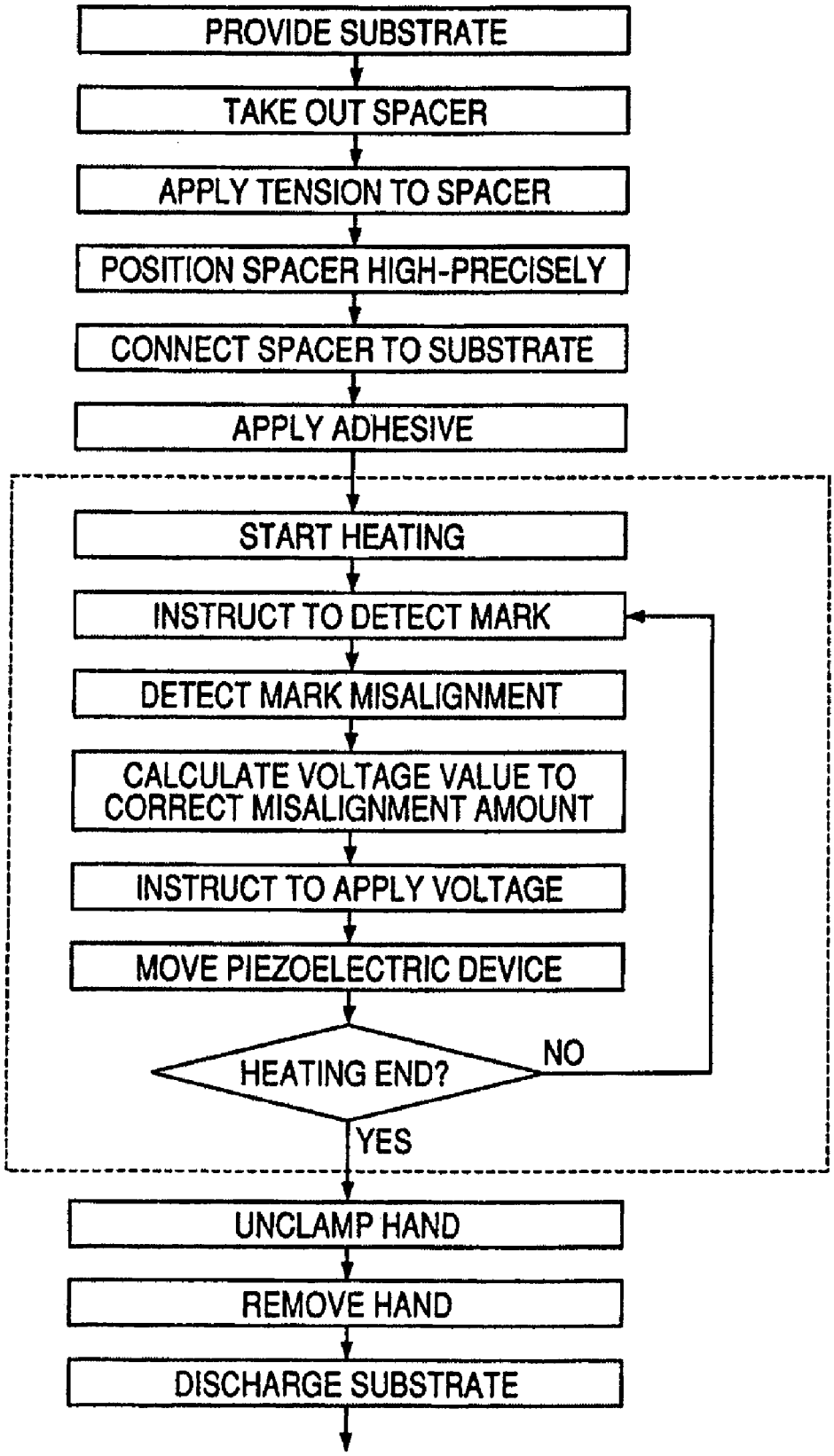
FIG. 6 is a flow chart for describing a procedure of a spacer assembling process in the present invention.

Incidentally, a process of assembling the spacers by using the above-described spacer assembling apparatus is performed according to a procedure illustrated in FIG. 6.

First, the substrate 1 is provided to a predetermined position on the table illustrated in FIG. 3, and the hand units 13 are lowered to the spacer magazine 11. Then, the both ends of the spacers 3 are clamped by the hands 15*a*, 15*b* and 15*c*, and the spacers 3 are taken out of the spacer magazine 11.

Subsequently, the hand units 13 are moved above the table 10, and tension is applied to the spaces 3 clamped by the hands 15*a*, 15*b* and 15*c* so as to make them straight.

Figure 7:
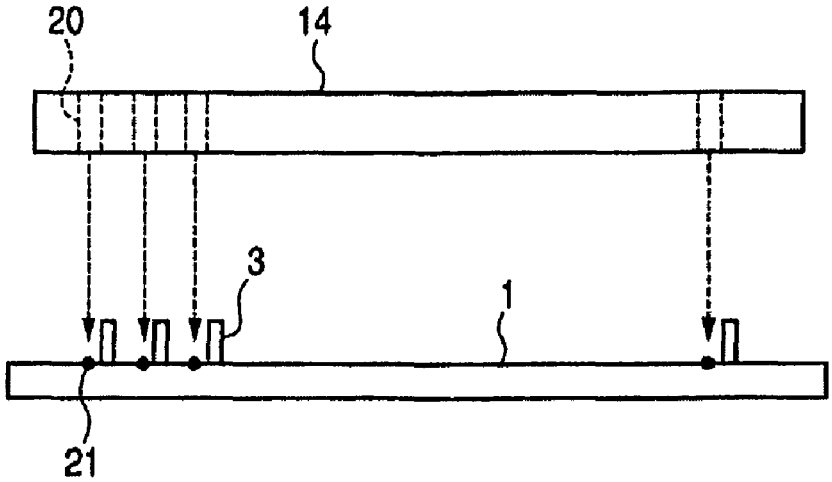
FIG. 7 is a diagram for describing alignment by using cameras and alignment marks.
Figure 8:
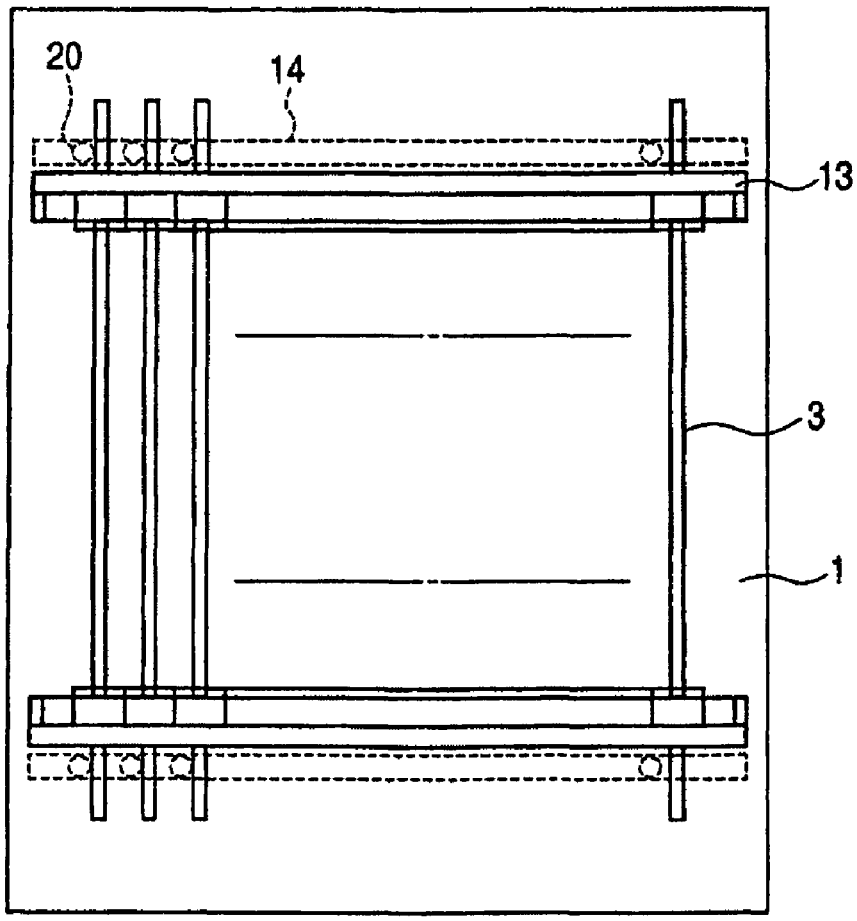
FIG. 8 is a plan view illustrating a state that spacers clamped by the hands came into contact with a substrate.

After the hand units 13 ware moved above the table 10, as illustrated in FIG. 7, each of alignment marks 21 which indicates the position where each of the spacers 3 has been attached and assembled to the substrate 1 located on the table 10 is detected by each of cameras 20 of the camera unit 14. Then, the position of each of the hands 15*a*, 15*b* and 15*c* is adjusted by expanding and contracting the expansion/contraction unit of the micro-movement mechanism 17 so that the position of each of the spacers 3 comes to the correct position.

Figure 9:
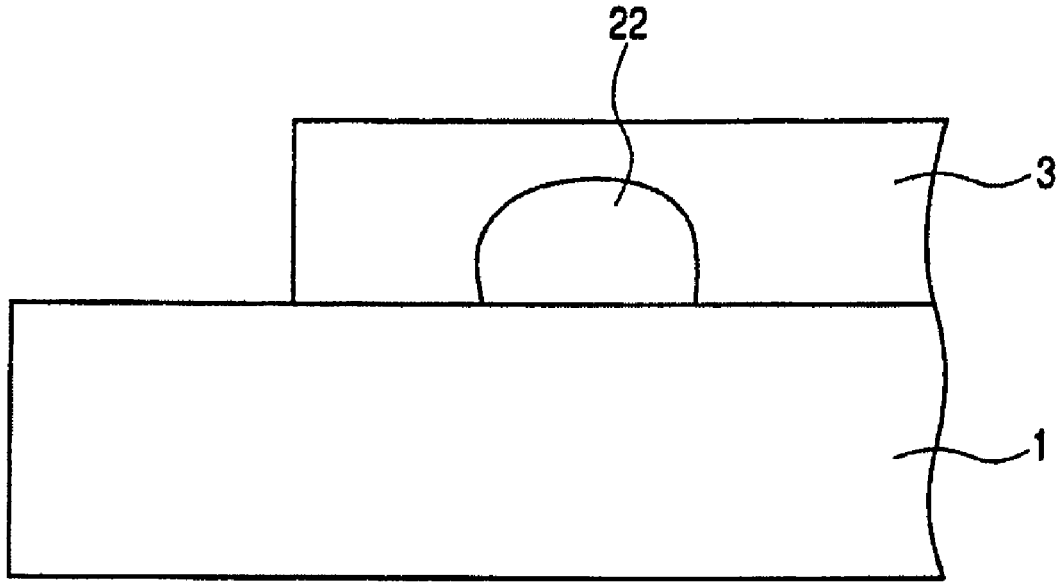
FIG. 9 is a diagram for describing an adhered state of the spacer.
Figure 10:
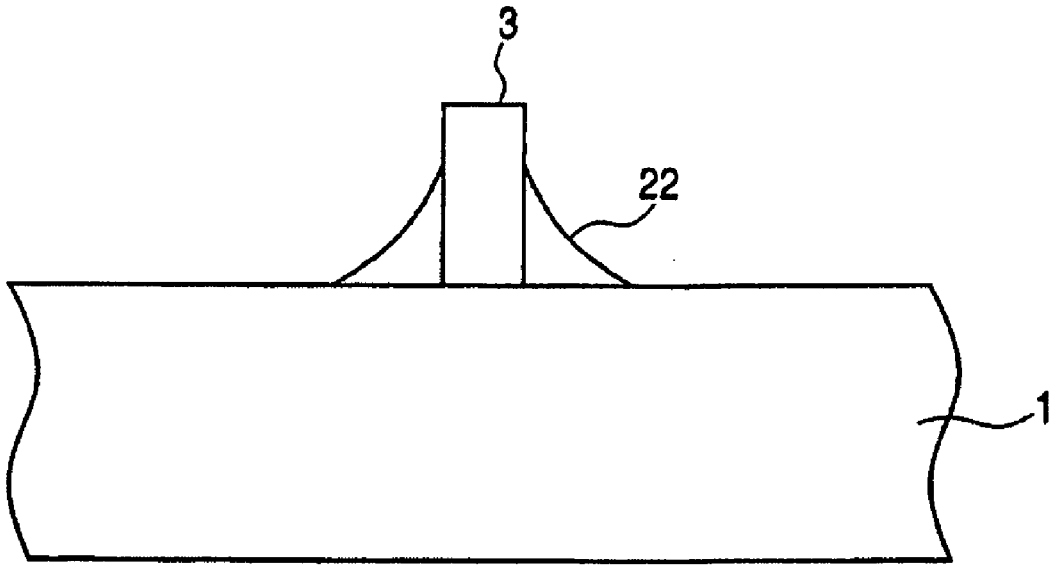
FIG. 10 is a diagram for describing the adhered state of the spacer.

After the positioning of each of the spacers 3 was completed, the hand units 13 are lowered onto the substrate 1 so that the respective spacers 3 come into contact with the substrate 1 in a lump. Then, as illustrated in FIGS. 9 and 10, an adhesive 22 is applied between each of the spacers 3 and the substrate 1. Here, it is preferable to apply the adhesive 22 across the both side surfaces of the both ends of the spacer 3 and the surface of the substrate 1. Incidentally, if applying nozzles (not illustrated) capable of ascending and descending have been previously mounted on the column 12, the adhesive 22 can be easily applied by pushing out the adhesive through the nozzles. Further, it should be noted that an adhesive, such as a ceramics adhesive, which is hardened by heating can be used as the adhesive 22.

After the adhesive 22 was applied, the adhesive 22 is heated for hardening. Incidentally, if hot air nozzles (not illustrated) capable of ascending and descending and blowing hot air have been previously mounted on the column 12, the adhesive 22 can be easily heated by blowing through the nozzles the hot air to the region on which the adhesive 22 has been applied. Also, if a heater has been built in the table 10, the adhesive 22 can be hardened by heating the whole of the substrate 1 with use of the built-in heater.

In any case, even in a case where local heating is performed by using the hot air nozzles, the heat expansion of the substrate 1 occurs. For this reason, the positions of the spacers 3 clamped by the hands 15*a*, 15*b* and 15*c* become misaligned in regard to the substrate 1 according to the heat expansion of the substrate 1. Consequently, to cope with such inconvenience, the alignment marks 21 on the substrate 1 are detected by the respective cameras 20 of the camera unit 14 while the adhesive 22 is being heated, and the expansion/contraction units of the respective micro-movement mechanisms 17 are expanded and contracted based on the detected results so that the positions of the spacers 3 come to the correct positions respectively. Then, by doing so, the pitch of the adjacent hands among the hands 15*a*, 15*b* and 15*c* is adjusted according to the heat expansion of the substrate 1. Here, it should be noted that, if the piezoelectric device is used as the micro-movement mechanism 17, the pitch of the adjacent hands among the hands 15*a*, 15*b* and 15*c* can be adjusted by a submicron unit.

Hereinafter, the pitch adjustment for the hands 15*a*, 15*b* and 15*c* will be further described in detail. Each of the alignment marks of which the number is equivalent to the number of the spacers 3 on the rear plate 1 is detected by using the corresponding camera 20, whereby a misalignment amount (or a shift amount) of the hand from its regular position is detected. Here, it should be noted that the camera 20 is provided for each of the hands 15*a*, 15*b* and 15*c*. Then, if the piezoelectric device is used as the micro-movement mechanism 17, a voltage value necessary to correct the misalignment amount of each hand is calculated, and voltage having the calculated voltage value is applied to the micro-movement mechanism 17 of the relevant hand. By doing so, the necessary hands 15*a*, 15*b* and 15*c* are respectively moved according to the corresponding misalignment amounts, whereby the pitches of these hands are corrected.

Such corrections of the pitches of the hands according to the heat expansion of the substrate 1 continue until the end of the heating. After the heating was completed, the spacers clamped by the hands 15*a*, 15*b* and 15*c* are unclamped. Subsequently, the hand units 13 are lifted and removed, and then the substrate 1 to which the spacers 3 have been attached and assembled is picked up from the table 10.

By performing the spacer assembling process as described above, it is possible to adjust the pitches of the spacers 3 according to the heat expansion of the substrate 1, whereby it is possible to high-accurately assemble the spacers 3.

Incidentally, in a case where the heat expansion of the substrate 1 is constant, it is unnecessary to provide the cameras 20 in correspondence with all the hands 15*a*, 15*b* and 15*c*. That is, in this case, it is possible to provide only three cameras, i.e., the camera 20 corresponding to the central hand 15*a* and the two cameras 20 corresponding to the both-end hands 15*b*. Also, in this case, it is possible to calculate, from a quantity of the heat expansion of the both-end hands 15*b*, a quantity of the heat expansion of the intermediate hands so that the calculated quantity of the heat expansion of the intermediate hands follows the quantity of the heat expansion of the both-end hands.

In addition, although the piezoelectric device is used as the micro-movement mechanism 17 in the above embodiment, the present invention is not limited to this. That is, for example, the desired object of the present invention can be attained even in case of using the micro-movement mechanism 17 functioning due to heat expansion.

While the present invention has been described with reference to the exemplary embodiment, it is to be understood that the invention is not limited to the disclosed exemplary embodiment. The scope of the following claims is to be accorded the broadest interpretation so as to encompass all such modifications and equivalent structures and functions.

This application claims the benefit of Japanese Patent Application No. 2008-113330, filed Apr. 24, 2008, which is hereby incorporated by reference herein in its entirety.

What is claimed is:

1. A manufacturing method of an image display apparatus which has plural spacers for defining a distance between substrates, the manufacturing method comprising:

assembling spacers by clamping both ends of each of the spacers in a longitudinal direction thereof respectively with individual hands;

positioning the spacers on one of the substrates in a lump;

applying an adhesive to the positioned spacers;

heat hardening the adhesive; and fixing the spacers to which the adhesive was applied to the one of the substrates, wherein, in the assembling of the spacers, a pitch of the hands is adjusted according to heat expansion of the substrate in a pitch direction of the spacers that occurs due to the heating of the adhesive, such that each of the hands is provided to be independently moved in the pitch direction of the spacers.

2. A manufacturing method according to claim 1, wherein the adjustment of the pitch of the hands is performed by a piezoelectric device.

3. A manufacturing method according to claim 1, wherein the adjustment of the pitch of the hands is performed by detecting a misalignment amount between an alignment mark provided on the one of the substrates and a regular position of one of the hands and correcting the detected misalignment amount.

* * * * *